United States Patent [19]

Ielpo

[11] Patent Number: 4,472,891

[45] Date of Patent: Sep. 25, 1984

[54] BIMETALLIC COMPOSITE COIN BLANK FOR COINS, MEDALS AND THE LIKE

[75] Inventor: Nicola Ielpo, Rome, Italy

[73] Assignee: Istituto Poligrafico e Zecca dello Stato, Rome, Italy

[21] Appl. No.: 408,688

[22] Filed: Aug. 16, 1982

[30] Foreign Application Priority Data

Aug. 27, 1981 [IT] Italy ..... 49182 A/81

[51] Int. Cl.[3] ..... A44C 21/00

[52] U.S. Cl. ..... 40/27.5; 428/64; 428/66; 428/542.8; 428/579; 428/927

[58] Field of Search ..... 40/27.5; 428/64, 66, 428/542.8, 579, 927

[56] References Cited

U.S. PATENT DOCUMENTS 632,938 9/1899 Greenburg ..... 40/27.5
2,098,892 11/1937 Sintz ..... 16/2
3,499,739 3/1970 Segel ..... 428/579

FOREIGN PATENT DOCUMENTS 191288 6/1937 Switzerland ..... 40/27.5
413829 7/1934 United Kingdom .
1483700 8/1977 United Kingdom ..... 428/3
2019195 10/1979 United Kingdom ..... 428/14

*Primary Examiner*—Henry F. Epstein
*Attorney, Agent, or Firm*—Hopgood, Calimafde, Kalil, Blaustein & Judlowe

[57] ABSTRACT

A coin blank for the coining of coins, medals and like products, obtained by the forced joining of two metal parts, each of them being of different metal or metal alloy, one forming the internal central part and the other the external perimetrical part, said forced joining of said two component parts being carried out, in a definitive and inseparable way, preferably upon the minting operation.

3 Claims, 10 Drawing Figures

Figure 1A:
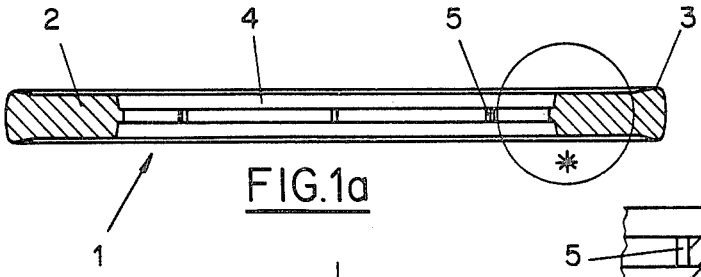

FIG.2a
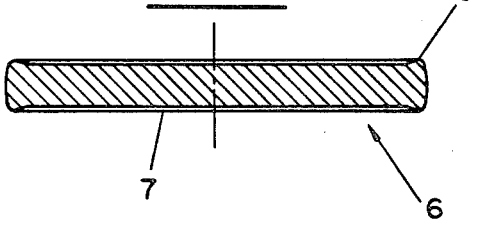
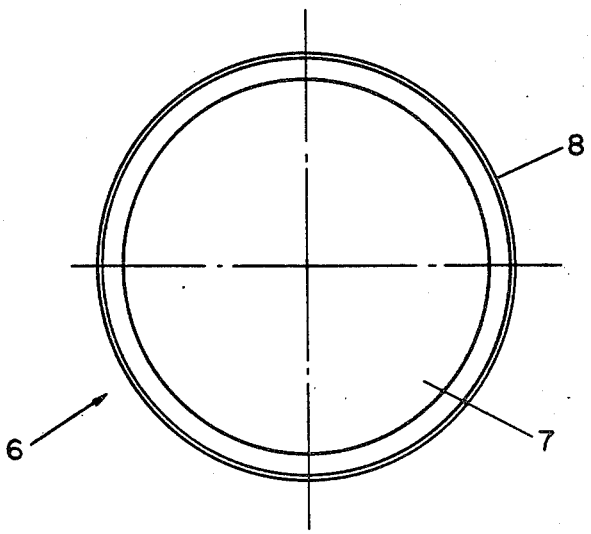
FIG.2b

BIMETALLIC COMPOSITE COIN BLANK FOR COINS, MEDALS AND THE LIKE

This invention refers to a coin blank formed by two metal parts, one external and the other internal, made integral one with the other, apt in a particular congenial way to be used in the coining of coins, medals and the like.

The metal coins, medals and the like are generally obtained imprinting, through coining, representations, signs and pre-established symbols on metal disks, so-called coin blanks, of various thickness and various diameter, and it should be noticed, however, that such denomination is also intended to mean, for reasons of ease of description, any piece which is to be minted, having a shape which is different from the circular one.

With particular reference to metal coins, the starting coin blanks are normally formed by a single alloy of two or more metals or even by several layers of different metal alloys, obtained through plating.

Such coin blanks, through generally employed, are not free from inconveniences deriving from limitations of versatility of performance and functionality since they are mainly bound to the weight and physical and mechanical characteristics of the used material, especially as far as the monometallic coin blanks are concerned.

Through the bimetallic coin blanks according to the invention the inconveniences of the similar products of the prior art are overcome, or at least reduced to a minimum, thus obtaining among others the following combination of advantages:

- possibility of changing the weight of the finished product without varying the dimensions thereof;
- possibility of changing the electric and magnetic characteristics of the finished product by effect of the variation of the dimensions and of the nature of the materials forming the two component parts;
- possibility of variation of the costs with relation to the quantity and to the type of the material which forms each of the component parts;
- greater assurance against falsifications since the production of bimetallic coin blanks according to the invention through improvised means would be too expensive and would absorb the profits on which generally coin forgers rely;
- greater assurance against frauds in automatic distributing machines, due to the particular physical properties of the bimetallic coin blanks according to the invention being not easily reproduceable in conventional coin blanks;
- possibility of creating two-coloured coins.

It is therefore the object of this invention to provide a bimetallic composite coin blank for coins, medals and the like, presenting aspects of functionality and practicality which are highly above those of similar known products.

The invention will be illustrated more in detail further on by the description of a preferred embodiment thereof, concerning a coin blank for metal coins, quoted as an exemplifying and not limiting form, with reference to the enclosed drawings, wherein:

BIREF DESCRIPTION OF THE DRAWINGS

Figure 3A:
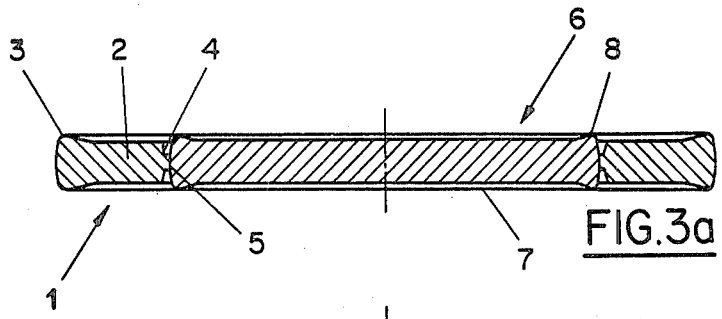
Figure 4:
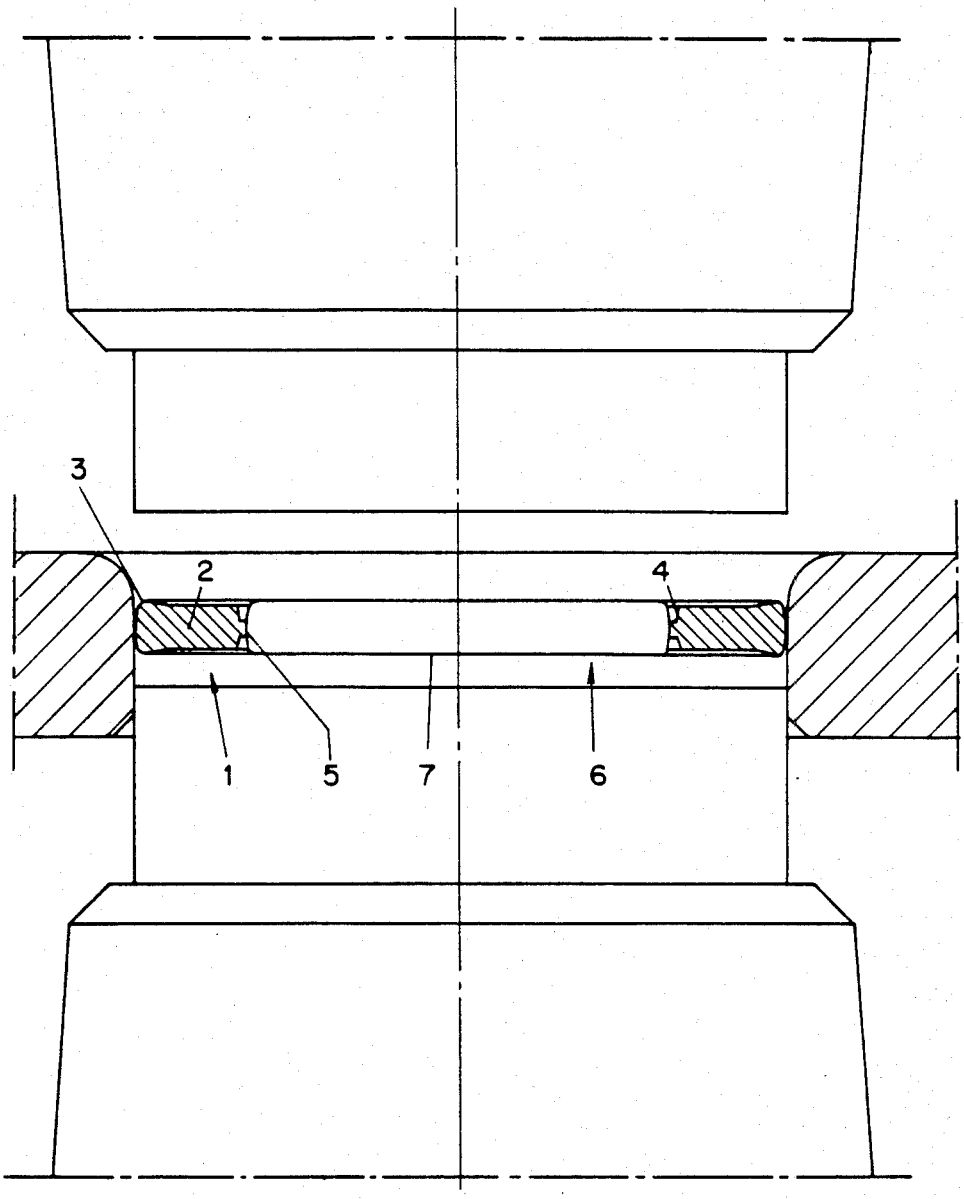
Figure 5:
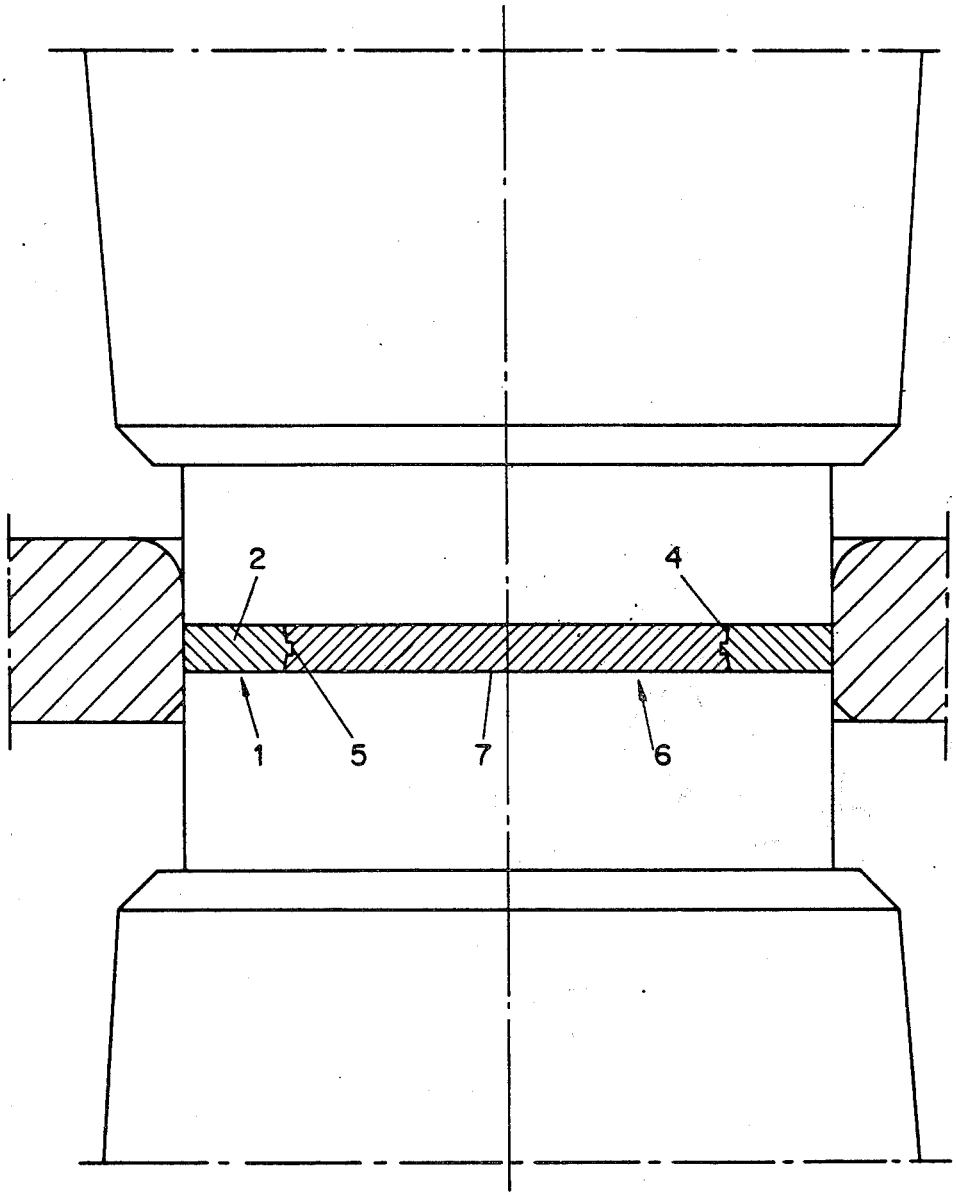

FIGS. 1*a, b, c, d* are respectively views in cross-section and in plan, of the external perimetrical part of bimetallic coin blank according to the invention and of a detail thereof in an enlarged scale, before the forced joining with the internal central part of FIG. 2;

FIGS. 2*a, b* are respectively views in cross-section and in plan, of the central internal part of the bimetallic coin blank according to the invention before the forced joining with the external part of FIG. 1;

FIGS. 3*a, b* are respectively views in cross-section and in plan, of the external part and internal part of FIGS. 1 and 2, respectively, of the bimetallic coin blank according to the invention in the assembled condition and before the forced joining;

FIG. 4 is a view respectively in cross-section of the external part of FIG. 1 and in elevation of the internal part of FIG. 2 of the bimetallic coin blank according to the invention in the assembled and precompressed condition, these being shown as positioned in a schematically shown coin press; and FIG. 5 is a cross-sectional view of the bimetallic coin blank according to the invention after the forced joining of the external and internal parts of FIG. 1 and respectively 2 by the acton of mintage of the coin press of FIG. 4.

With reference to FIG. 1 the external perimetrical part of the bimetallic coin blank according to the invention to be used for the mintage of coins, is indicated generically at 1.

Figure 1B:
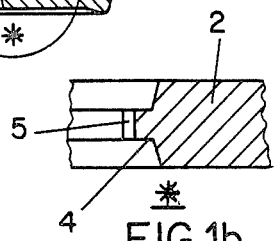
Figure 1C:
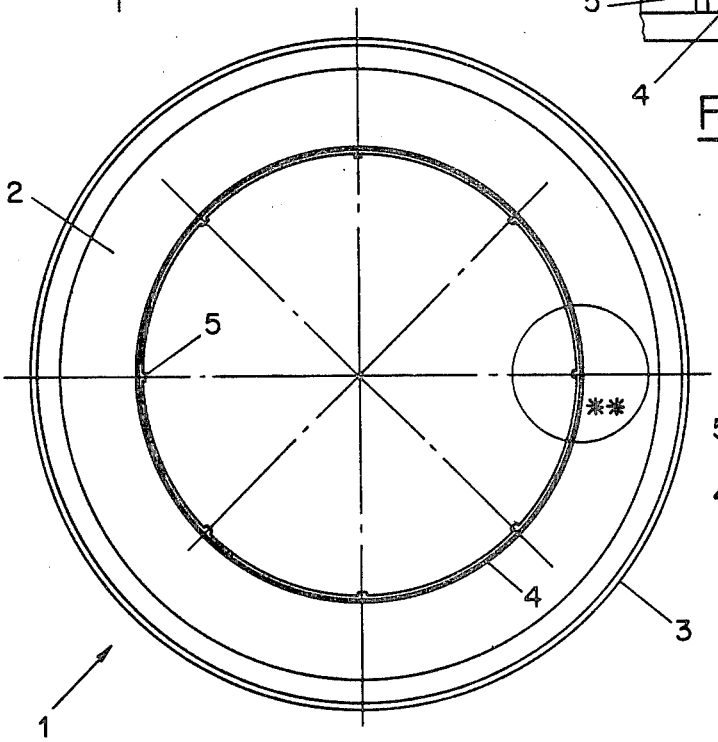
Figure 1D:
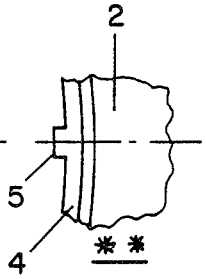

The external perimetrical part 1 is formed by a circular crown 2 of a metal alloy or adequate metal, generally showing a slight swell of the outer perimetrical edge, that is a "hemming" 3, while the internal perimetrical edge, as best shown in detail in FIGS. 1*b* and 1*c*, has the form of a tapering 4 such to obtain a circumferential edge considerably reduced, from the face of which, towards the inside, a certain number of small teeth 5 protrude integrally in a radial direction.

FIG. 2 shows the internal central part, indicated generally in 6, of the bimetallic coin blank in question, herein formed by a disk 7 in metal alloy or metal different from that of the external perimetrical part 1, said disk showing also a hemming 8.

The diameter of the disk 7 is essentially the same as the diameter of the circumference passing by the free ends of the small teeth 5 protruding from the reduced edge portion of the internal perimeter of the circular crown 2.

Figure 3B:
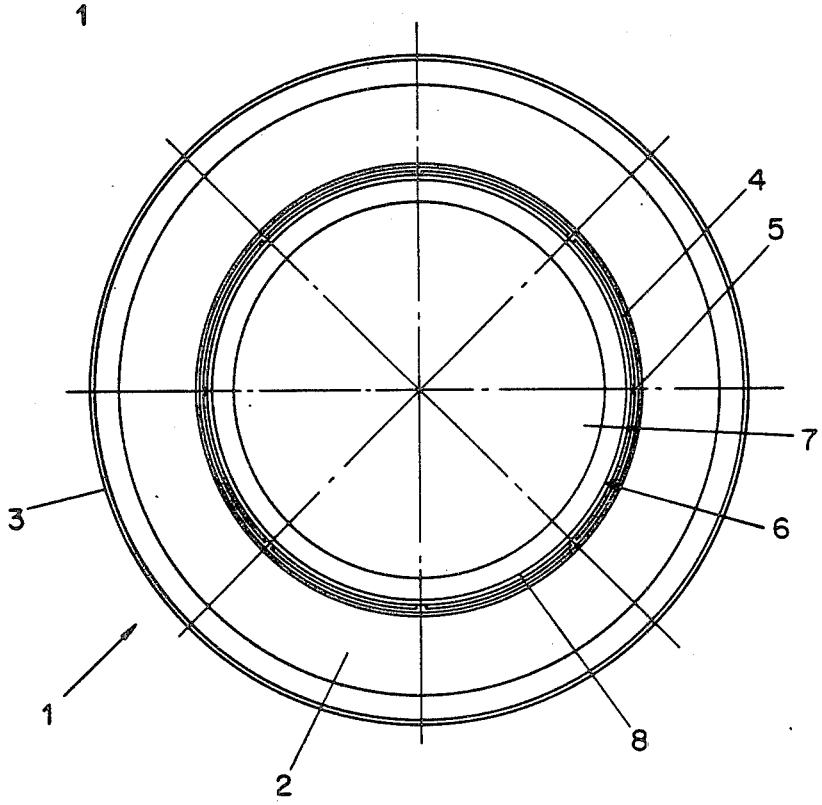

For the formation of the bimetallic coin blank according to the invention the component elements described above are placed in a conventional mechanical press with the internal central part 6 adapted in the circular opening of the external perimetrical part 1 (see FIG. 3) and they are subjected to a slight compression for carrying out an interference joining of the said parts, merely to prevent detachment of one from the other during handling for the following operations.

The bimetallic coin blank so precompressed is then positioned in a conventional coin press, as shown in FIG. 4, in which it undergoes the operation of minting which determines the final joining in an inseparable way of the internal and external components. In fact, during the above mentioned operation, due to the strong pressure exerted by the coining cones on the two faces of the bimetallic coin blank, the components thereof described above are subjected to an action of squashing during which, as can be observed in FIG. 5, the central disk 7 expands in a larger amount with respect to the external circular crown 2, contained in the ferrule of the press, filling by plastic sliding the free spaces of the tapering 4 of the inside perimetrical edge of the circular crown 2 while the small teeth 5 penetrate in the side surface of the disk 7 preventing any whatsoever relative rotation movement between the two components.

The resulting forced joining is therefore such that it does not leave any degree of freedom of reciprocal movement of the parts which form the bimetallic coin blank according to the invention.

Although the example of embodiment according to the present invention described above has been referred to a coin blank for coining metal coins wherein both the internal central part and the perimetrical external part are of a circular form, it is possible, as already stated, to vary at will for other applications, for example in the production of medals and the like, the form of one or both the components as long as obviously the outside contour of the central internal part corresponds to the inside contour of the perimetrical external part.

Therefore this invention is not limited to the example of embodiment described but comprises any variation of execution thereof.

I claim:

1. A bimetallic coin blank for coins, medals and the like comprising:

(a) an internal part formed by a first metal;

(b) an external part formed by a second metal, said external part having a central opening constructed and arranged to receive said internal part, the internal edge of said central opening being tapered;

(c) a plurality of projections integral with said tapered internal edge disposed radially about said central opening; and (d) the outer peripheral rim of said internal part being thicker than said external part.

2. The bimetallic coin blank according to claim 1, wherein the outer peripheral rim of the external part is thickened.

3. The bimetallic coin blank according to claims 1 or 2, wherein said external and internal parts are inseparably joined through a coining operation in a coin press.

* * * * *